United States Patent [19]

Iwashita

[11] 4,152,534

[45] May 1, 1979

[54] FURNACE ROOF FOR THE ELECTRIC ARC FURNACE

[75] Inventor: Kenji Iwashita, Kyoto, Japan

[73] Assignee: Kyoei Seiko Kabushiki Kaisha, Osaka, Japan

[21] Appl. No.: 858,894

[22] Filed: Dec. 9, 1977

[30] Foreign Application Priority Data

Dec. 8, 1976 [JP] Japan ..... 51-165059[U]

[51] Int. Cl.[2] ..... F27D 1/02

[52] U.S. Cl. ..... 13/35; 110/335

[58] Field of Search ..... 13/35, 9 R; 110/335, 110/331

[56] References Cited

U.S. PATENT DOCUMENTS

| | | | |
|---|---|---|---|
| 3,756,172 | 9/1973 | Brereton et al. | 13/35 X |
| 3,967,048 | 6/1976 | Longenecker | 13/35 |
| 4,021,603 | 5/1977 | Nanjyo et al. | 13/35 |

*Primary Examiner*—R. N. Envall, Jr.

*Attorney, Agent, or Firm*—Wenderoth, Lind & Ponack

[57] ABSTRACT

A furnace roof for an electric arc furnace which is divided into several blocks so that local damage, if any, of the furnace roof can be repaired easily by replacing a block which has been damaged with a new spare one, without taking down the whole furnace roof for repairs.

4 Claims, 6 Drawing Figures

FURNACE ROOF FOR THE ELECTRIC ARC FURNACE

This invention relates to a furnace roof for an electric arc furnace which is divided into several blocks so that local damage, if any, of the furnace roof can be repaired easily by replacing a block which has been damaged with a new spare one, without taking down the whole furnace roof for repairing.

In a conventional electric arc furnace, the desired furnace roof is constructed by incorporating in an arch-shaped structure many refractory bricks of rectangular shape or trapezoidal shape and placing them on an annular furnace roof ring to be fitted on the top of the electric furnace proper. However, when incorporating refractory bricks, several holes through which electrodes and a connecting line of a dust collector for collecting dust in the furnace must be made in the furnace roof and therefore refractory bricks adjacent these holes will be worn sooner than those in the other parts. Thus, it is often experienced that even if refractory bricks in the other parts of the roof are still in good condition, the furnace roof must be taken off the electric furnace proper to make intermediate repairs of the worn part or all refractory bricks of the furnace roof must be renewed. This is not only uneconomical but also takes time for repairs or renewal of the furnace roof. In addition, operation of the electric furnace must be suspended while the furnace roof is under repair, resulting in lowering of working efficiency of the electric furnace. Furthermore, with the recent tendency to adopt a larger size electric furnace, the weight of refractories used for the furnace roof increases and the refractory bricks cannot be supported fully by the furnace roof ring.

The present invention provides a furnace roof which eliminates the above-described drawbacks of the conventional furnace roof.

The nature and advantages of the present invention will be understood more clearly from the following description made with reference to a preferred embodiment of the present invention as shown in the accompanying drawings, in which.

Figure 1:
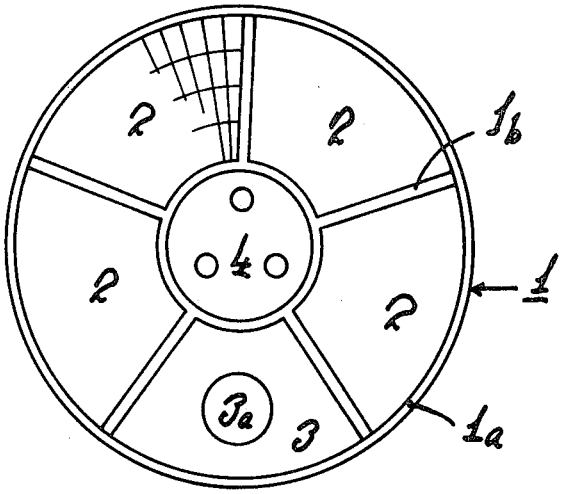
FIG. 1 is a plan view showing the furnace roof of an electric arc furnace.
Figure 2:
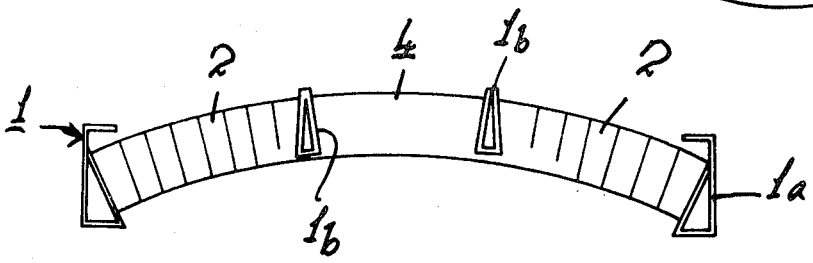
FIG. 2 is a cross section of the furnace roof shown in FIG. 1.
Figure 3:
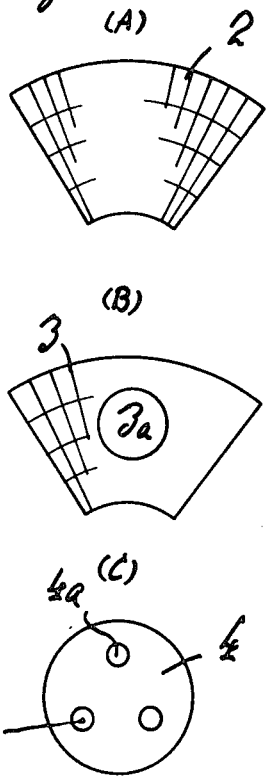
FIG. 3A is a plan view of a furnace roof block with no holes for electrodes or for a connecting line of the dust-collector.
FIG. 3B is a plan view of the furnace roof block with a hole through which a connecting line of a dust-collector is passed.
FIG. 3C is a plan view of the furnace roof block with holes through which electrodes are passed.
Figure 4:
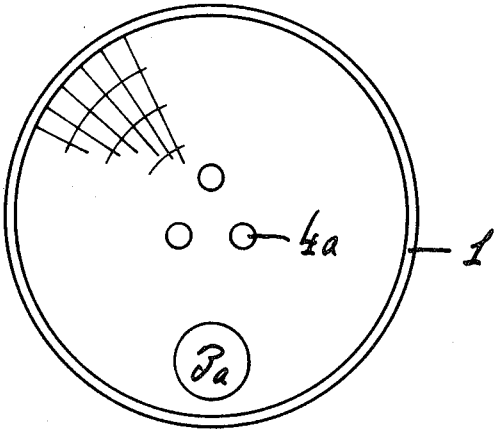
Fig. 4 PRIOR ART
FIG. 4 is a plan view of a conventional furnace roof for an electric arc furnace.

According to the present invention, the external shape of the furnace roof is defined by a ring-shaped water-cooled frame comprising a plurality of water-cooled sections. In each of the sections, a single refractory brick or a roof section comprising a plurality of refractory bricks is removably mounted and holes necessary for inserting electrodes, a connecting line of a dust collector, etc. are made therein. More particularly, a furnace roof according to the present invention is basically formed by a ring-shaped water-cooled frame, which has an outer ring. An inner ring-shaped water-cooled frame is arranged concentrically to the outer ring and thus an annular space is formed by the concentric outer and inner rings. The annular space is divided into a plurality of sectors by dividing frames connecting the outer and the inner ring-shaped water-cooled frames. Preferably, these dividing frames are arranged radially along diametrical lines of the outer ring. In each sector is removably fitted a single refractory brick or a roof section comprising a plurality of refractory bricks and holes for inserting electrodes, a connecting line of a dust collector, etc. are made at the desired positions in the sectors.

The drawings show an embodiment of the present invention. The furnace roof in this embodiment has an outer water-cooled frame 1*a* having a large diameter and an inner water-cooled frame 1*c* having a small diameter arranged concentrically to said outer frame. Water cooled dividing frames 1*b*, 1*b* . . . extend along diametrical lines in the outer frame in such a fashion that five equal sectors are formed between the outer and the inner frames. In each of these sectors of the water-cooled frame 1 a roof section comprising many refractory bricks of rectangular, trapezoidal or other shape bound together by metallic wires or with adhesives is removably fitted. In this case, sections 2 have a fan-shape, the section 3 has a fan-shape and has a hole 3*a* through which a connecting line of a dust-collector is passed and the section 4 is round and has holes 4*a* through which electrodes are passed. The section 3 having a hole through which a connecting line of a dust-collector is passed usually wears and must be replaced earlier than the sections 2 and 4. In this case, the section 3 alone is removed for repairs or is replaced with a new one, without taking down the whole furnace roof. Thus, the repair can be done easily and accordingly lowering of the working efficiency of the furnace caused by repairing of the furnace roof can be minimized.

In order to prevent the refractory material of the furnace roof from being distorted and deformed, it is generally the practice to adopt a system such as the so-called "suspended ceiling". According to the present invention, the furnace roof is divided into several sections by dividing frames, which have the same function as the suspended ceiling and prevent the furnace roof from being distorted or deformed by the weight of refractory bricks, which results in a longer life of the furnace roof.

What is claimed is:

1. In an electric arc furnace, a roof comprising an outer ring-shaped water-cooled frame and an inner ring-shaped water-cooled frame concentric with said outer ring-shaped frame, said frames defining an annular space therebetween, a plurality of water-cooled frame members extending between said inner and outer frames and dividing said annular space into a plurality of sectors, and a roof section consisting of refractory material removably fitted into each sector and into the space within said inner frame and filling said sectors and inner frame, at least one of said roof sections said sectors having a hole therein through which a dust collector can be passed, and said roof section in said inner frame having a plurality of holes therein through which electrodes can be passed.

2. A roof as claimed in claim 1 in which said frame members extend radially of said concentric frames.

3. A roof as claimed in claim 1 in which said roof sections are each a single block of refractory material.

4. A roof as claimed in claim 1 in which said roof sections are each a plurality of refractory bricks.

* * * * *